United States Patent [19]

Wilbur

[11] 3,960,432

[45] June 1, 1976

[54] STRAIN RELIEVER FOR ELECTRIC PLUG-SOCKET CONNECTION

[76] Inventor: Raymond Francis Wilbur, 3329 Quesada Drive, San Jose, Calif. 95122

[22] Filed: July 2, 1975

[21] Appl. No.: 592,559

[52] U.S. Cl. ..... 339/103 R; 339/75 P

[51] Int. Cl.[2] ..... H01R 13/58

[58] Field of Search ..... 339/103 R, 104, 106, 339/75 P, 76–79

[56] References Cited

UNITED STATES PATENTS

| | | | |
|---|---|---|---|
| 2,089,665 | 8/1937 | Roberts et al. | 339/75 P |
| 2,913,791 | 11/1959 | Martin | 339/75 P X |
| 3,838,383 | 9/1974 | Wilbur et al. | 339/75 P |

*Primary Examiner*—Roy Lake
*Assistant Examiner*—DeWalden W. Jones
*Attorney, Agent, or Firm*—Robert Charles Hill

[57] ABSTRACT

A strain reliever for an electric appliance cord for preventing application of the force applied to electric cord from disengaging the plug at the end of the cord from a socket or a receptacle. An apertured body secured to the receptacle cover plate and a ball chain one end of which is engagable in the apertures. The opposite end of the ball chain has a cord clip for engaging an electrical cord so that when the plug at the end of the cord is engaged in the receptacle any strain on the cord will be taken up by the chain, rather than by the plug-socket engagement.

6 Claims, 7 Drawing Figures

STRAIN RELIEVER FOR ELECTRIC PLUG-SOCKET CONNECTION

BACKGROUND OF THE INVENTION

1. Field of the Invention:

This invention relates to a cord strain reliever to prevent inadvertent disconnection of a plug from a wall socket when force is applied to the cord connected to the plug. More particularly the invention relates to a strain reliever that can be mounted on existing receptacle over plates without modification of the cover plate.

2. Description of the Prior Art:

U.S. Pat. No. 3,838,383 (339/75P) discloses a device for relieving strain on an electric plug that is plugged into a wall mounted receptacle. The devicce described in the U.S. Pat. No. 3,838,383 patent has substantially eliminated a long standing problem; the present invention constitutes an improvement thereover.

SUMMARY OF THE INVENTION

The embodiment of the invention that is described in detail hereinafter includes an apertured body that defines a central hole sized to receive the screw present in electric receptacles for retaining a decorative and protective cover plate on the receptacle. Extending in opposite directions from the screw hole are portions in which are defined key shaped apertures oriented on mutually perpendicular axes. Each key shaped aperture includes a relatively large diameter circular portion and a relatively smaller slot extending from the large diameter circular portion.

A ball chain having balls or spheres smaller than the diameter of the circular portion of the aperture and larger than the diameter of the slot is employed. The end ball can be introduced into the circular portion and moved into the slot whereupon the ball chain is retained onto the body. On the distal end of the ball chain is a cord clip which engages the electrical cord connected to the plug so that strain on the cord is taken up by the clip, ball chain, and apertured body rather than being applied to the plug in such a way as to effect inadvertent disconnection of the plug from the receptacle.

An object of the present invention is to provide a cord strain reliever that can be installed by unskilled persons utilizing no other tool than a screwdriver. This object is achieved because the above mentioned aperture body is retained onto the receptacle by the screw that is present for retaining the plate onto the receptacle.

Another object of the present invention is to provide a cord strain relieving device that can be utilized with equal facility whether a receptacle is mounted in a vertical orientation or in a horizontal orientation. The present invention affords achievement of this object because there are two keyhole shaped apertures that are oriented in mutually perpendicular relationship to one another. Thus irrespective of the orientation of the receptacle, the body can be installed so that one of the apertures is oriented so that the slot is in vertical alignment below the circular aperture portion whereby the ball chain is gravitationally biased in place.

The foregoing together with outer objects, features and advantages of the invention will be more apparent after referring to the following specification and the accompanying drawing.

DESCRIPTION OF THE PREFERRED EMBODIMENT

Figure 1:
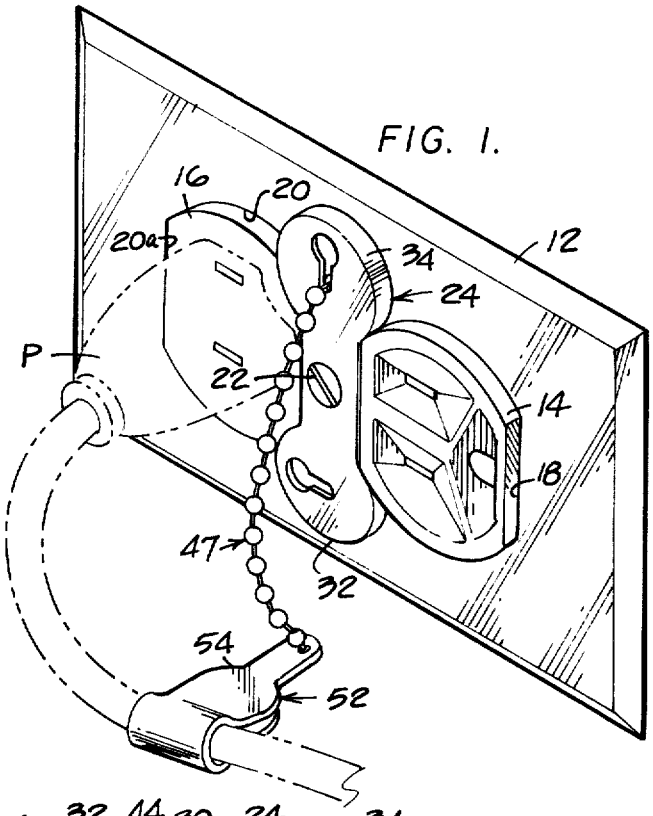
FIG. 1 is a perspective view of a horizontally oriented duplex wall receptacle on which is installed a cord strain reliever according to the invention.

Referring more particularly to the drawing, reference numeral 12 indicates a decorative and protective cover plate of conventional form which is installed over an electrical receptacle, in this case a duplex receptacle having two sockets 14 and 16 to which access is had through congruently shaped openings 18 and 20 in plate 12. The receptacle structure of which sockets 14 and 16 are a part is rigidly retained in a wall mounted junction box by fasteners not shown and defines a centrally located threaded hole in which a screw 22 is threaded to retain cover plate 12 onto the receptacle. Thus in the conventional assembled condition sockets 14 and 16 are accessible for a cord plug P to be mechanically and electrically engaged in the sockets.

According to the present invention there is an apertured body 24 which has a centrally disposed hole 26 through which screw 22 is installed to retain body 24 in place centrally of cover plate 12 and between sockets 14 and 16. Because screw 22 typically has a flat or oval head, hole 22 is countersunk at 28. Body 24 is constructed of any suitable rigid matrial of sufficient strength and has a central portion 30 which defines two mutually parallel straight edges which are symmetrical of hole 26. The width of central portions 30, i.e. the distance between the two edges, is preferably slightly less than 7/16ths of an inch, the typical approximate distance between receptacle sockets 14 and 16. This dimensional relationship in addition to affording a more attractive attachment eliminates interference with the receptacle sockets and, in those installations where the sockets protrude outward of the front surface of plate 12, retain body 24 against rotation should screw 22 become slightly loose. The length of central portion 30, in the exemplary receptacle referred to above, is about ¾ths of an inch, the distance of the flat indicated at 20*a* of opening 20 in cover plate 12.

Figure 2:
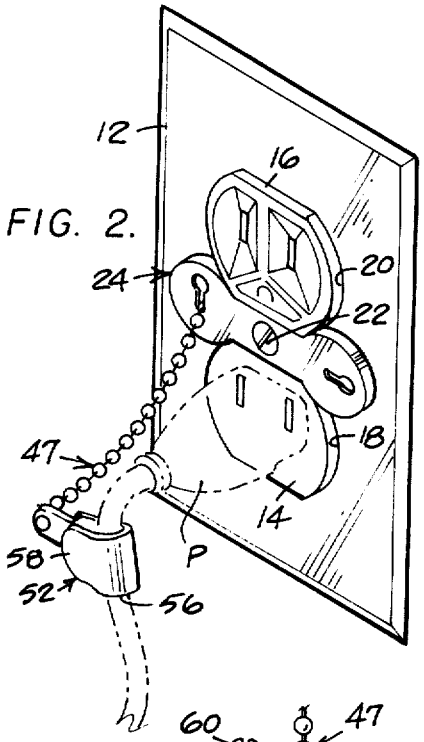
FIG. 2 is a perspective view of a vertically oriented duplex receptacle equipped with the device of the present invention.
Figure 3:
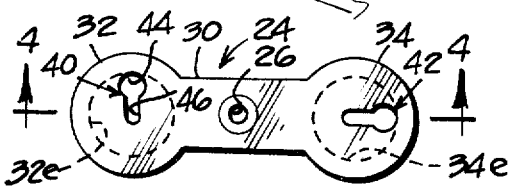
FIG. 3 is a plan view of the aperture body constituting one element of the present invention.
Figure 7:
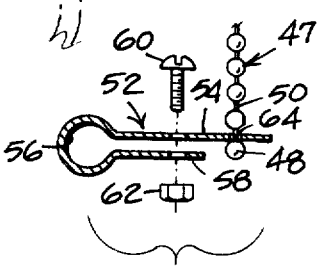
FIG. 7 is a view at enlarged scale of one satisfactory form of cord clip constituting an element of the invention.

Outward of central portion 30 body 24 has enlargements 32 and 34 which in the exemplary embodiment shown in the drawing are of generally circular shape so that the body has an overall dumbbell shape. In the inner surface of enlargements 32, 34 of body 24 are formed circular excisions 32*e* and 34*e* respectively, thereby forming relatively thin wall portions 36 and 38 in the respective enlargements. Formed in each enlargement 32, 34 in alignment with the excisions 32*e*, 34*e* are keyhole shaped openings designated respectively at 40 and 42. Each opening is shaped identically and includes a relatively large diameter circular portion 44 and an elongate slot portion 46 which communicates with circular portion 44 and has a width less than the diameter of the circular portion. As is seen most clearly in FIG. 3 aperture 40 is elongated on a vertical axis and aperture 42 is elongated on a horizontal axis, the latter axis being mutually perpendicular to the vertical axis. Thus, whether body 24 is oriented as shown in FIG. 1 or as shown in FIG. 2, one of openings 40, 42 can be oriented so that slot 46 is oriented vertically below circular portion 44.

Figure 4:
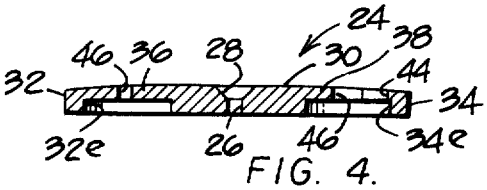
FIG. 4 is a cross-sectional view taken along line 4—4 of FIG. 3.
Figure 5:
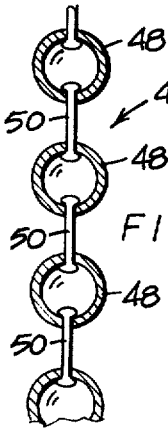
FIG. 5 is a fragmentary view in cross section of a ball chain that constitutes one element of the present invention.

The reason for this orientation can be appreciated by reference to FIG. 5. A conventional ball chain 47 employs a plurality of spheres or balls 48 joined by headed rods 50. In constructing the chain, in accordance with conventional practices, spheres 48 are crimped around the headed ends of rods 50 so that twisting or pivotal movement between the spheres and the rods can be effected. Having reference now in FIGS. 3 and 4, circular portions 44 of apertures 40, 42 have diameter larger than ball or sphere 48 so that a ball can be introduced into the aperture through the circular portion. The width of slot 46 is less than the diameter of balls 48 but greater than the diameter of rods 50 so that when the ball within one of the apertures is moved into slot 46, one end of chain 47 is retained in engagement with body 24. The thickness of wall portions 36, 38 is less than the length of rod 50 between adjacent balls 48 so that the ball chain will remain engaged within one of the apertures 40, 42 by gravity. The mutually perpendicular orientation of apertures 40 and 42 assures that one of the apertures can be oriented as is aperture 40 oriented in FIG. 3 so that chain remains in the aperture via gravity.

The end of ball chain 47 opposite that engaged within one of the apertures 40, 42 has secured thereto a cord clip 52. Cord clip 52 is preferably formed of resilient material, such as spring steel, and has a main body 54 one end of which is bent back to form a cord encircling loop portion 56. The loop portion has an inner diameter sufficient to embrace firmly the electrical cord but large enough to avoid adversely affecting the insulation and covering that is part of the cord. Extending in general parallel relationship to main body 54 is a leg 58 which is shorter than the main body. Although material having sufficient resilience to grip the appliance cord is available, in some instances it is preferred to form aligned openings in main body 54 and leg 58 to receive a screw 60 on the protruding end of which is threaded a nut 62. When the screw and nut combination are tightened the cord is firmly engaged within loop portion 56. At the end of main body 54 opposite from loop portion 56 there is an opening 64 formed in the main body, the opening having a diameter greater than ball chain rods 50 but less than the diameter of the spheres or balls 48. Accordingly the cord clip 52 is retained on the ball chain for pivotal movement relative thereto so that when the clip is installed on the cord there is sufficient freedom of movement to engage the opposite end of the ball chain into one of the keyhole shaped apertures 40,42.

In one typical commercial form of the invention, one purchases a kit containing body 24, a screw 22 of length in excess of that normally provided with a cover plate 12, and a ball chain 47 to one end of which is secured a cord clip 52. The original screw retaining cover plate 12 onto the electrical receptacle is removed, and body 24 is placed on the exterior surface of the cover plate with hole 24 aligned with the hole in the cover plate and in the duplex receptacle. Screw 22 is inserted and tightened to complete installation of the body. Obviously in installing the body on horizontally oriented receptacles as in FIG. 1, the body is oriented so that aperture 42 is as shown in FIG. 1, that is, with the circular opening portion 44 in vertical alignment above the slot portion 46 of the aperture. On the other hand, in installing the body onto vertically oriented duplex receptacles as depicted in FIG. 2, body 24 is installed so that the circular portion 44 of aperture 40 is in vertical alignment above slot portion 46 of the aperture. Cord clip 52 is then installed onto the appliance cord and optional screw 60 and nut 62 can be installed firmly to engage the cord within the clip. Thereafter the plug P is plugged into one of the receptacle sockets 14, 16 and the free end of chain 47 is engaged in the appropriate aperture by introducing the end ball through the circular portion of the aperture and then moving the chain downward into the slotted portion 46 whereupon the margins of the slot, or the wall portions 36 of reduced thickness, engage the ball and prevent dislodgment of the ball chain from body 24. This accordingly assures firm engagement of plug P into the receptacle notwithstanding axial forces on the cord.

Figure 6:
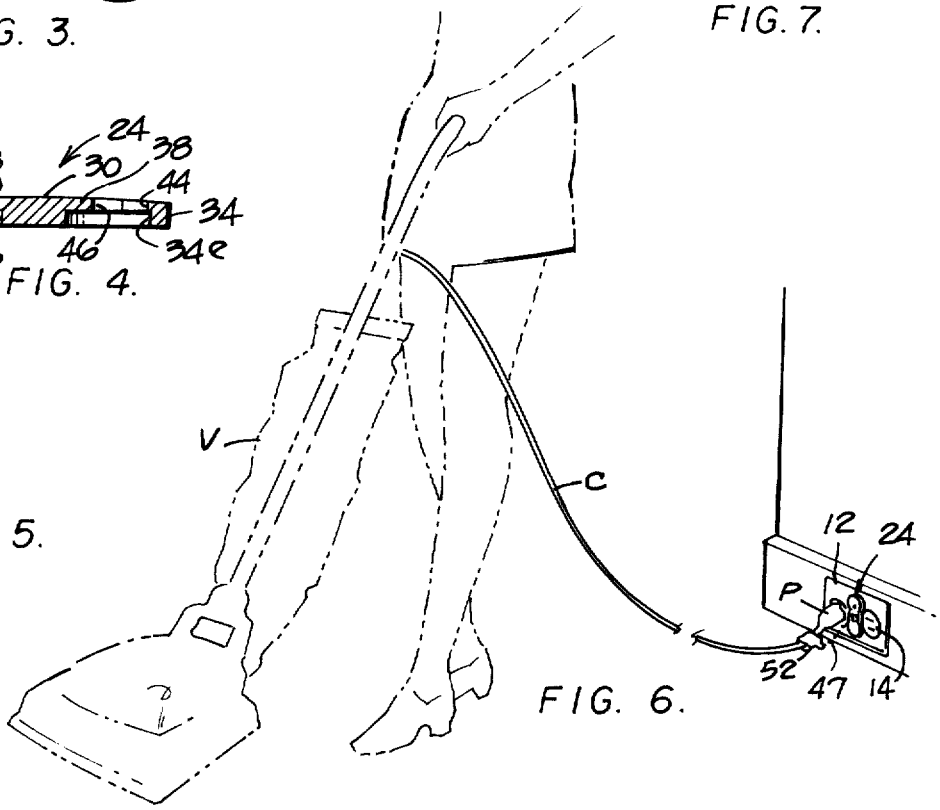
FIG. 6 is a perspective view illustrating an exemplary environment in which the invention defines application.

The advantages afforded by the invention can be appreciated by reference to FIG. 6. In FIG. 6 a vacuum cleaner V is connected via a cord C to a receptacle having a cover plate 12 and being supplied with the strain relieving apparatus of the invention. The user of the vacuum cleaner, when cord C is plugged into a receptacle supplied with the apparatus of the present invention, can devote his or her energies to operating the vacuum cleaner without concern about applying tension to the cord which might otherwise dislodge plug P from the receptacle. When it is necessary to move the vacuum cleaner to a location remote from the receptacle, the ball chain 47 can be quickly disengaged from the aperture and the plug P is disengaged from the socket in a normal way.

Thus it will be seen that the present invention provides a cord strain relieving apparatus for electrical appliances which can be installed on existing receptacle plates without special tools or special training of any kind. The apparatus does not in any way interfere with use of the receptacle without the strain relieving apparatus of the invention; it can however quickly be employed with the invention by introduction of ball chain 47 into the appropriately oriented keyhole shaped aperture. Although the invention has been described hereinabove in connection with an electric vacuum cleaner cord it should be understood that it has equal application to any portable electrical appliance including without limitation electric tools and appliances of all kinds. Although one embodiment of the invention has been shown and described it will be obvious that other adaptations and modifications can be made without departing from the true spirit and scope of the invention.

What is claimed is:

1. Strain relieving apparatus for an electrical plug on the end of an electrical cord that is plugged into an electrical receptacle having a cover plate during use of the appliance connected to the cord, said apparatus comprising a rigid body, screw means for attaching said cover plate and said body to said receptacle, said body defining at least one keyhole shaped aperture, said aperture having an upper relatively large diameter portion and a slot depending downward from said large diameter portion, said slot being bounded by a margin of reduced thickness, a ball chain having a plurality of balls joined together by a plurality of rods, said rods having a diameter sized for entry into said slot, said balls having a diameter sized for entry into said aperture and engageable on said margins to removably retain said ball chain in said slot and means for attaching the ball chain to the cord adjacent the plug.

2. Strain relieving apparatus according to claim 1 wherein said electrical receptacle includes a cover plate secured thereto by a screw and wherein said body attaching means comprises a portion of said body defining an opening sized to receive said screw therethrough so that said screw retains said body and said cover plate onto said receptacle.

3. Strain relieving apparatus according to claim 1 for installation onto a duplex electrical receptacle having two spaced apart sockets, said body having a central portion adapted to fit between said sockets, there being enlarged portions on said body at opposite ends of said central portion, said apertures being formed in respective said enlarged portions.

4. Strain relieving apparatus according to claim 3 wherein one of said slots is oriented generally parallel to said central portion and one of said slots is oriented perpendicular thereto.

5. Strain relieving apparatus according to claim 3 wherein said enlarged portions are of generally circular shape having a diameter greater than the width of said central portion so as to define a generally dumbbell shaped body.

6. Strain relieving apparatus according to claim 1 wherein said cord attaching means comprises a cord clamp secured to one end of said ball chain, said cord clamp being formed of a sheet of resilient material having a main body and an integral bent back portion in parallelism with the main body of said cord clip thereby defining a cord encircling loop portion, said bent back portion confronting the main body of said cord clip in spaced apart relation to afford insertion of said cord into said loop portion, said main body and said bent back portion formed with aligned holes adjacent said loop defining portion, and a threaded fastener extending through said holes for drawing the confronting portions together to tightly embrace a cord in said loop portion.

* * * * *